US006082047A

United States Patent [19]

Comaglio et al.

[11] Patent Number: 6,082,047

[45] Date of Patent: Jul. 4, 2000

[54] DRAFT STRIPS FOR DOORS INCLUDING A MOVABLE MEMBER CONNECTED TO AN ADJUSTING SLIDE

[76] Inventors: Aldo Comaglio; Caterina Vezzola, both of Via Roccolino 11, Gavardo (Brescia), Italy

[21] Appl. No.: 08/955,496

[22] Filed: Oct. 22, 1997

[30] Foreign Application Priority Data

Oct. 23, 1996 [IT] Italy ..... BS96A0084

[51] Int. Cl.[7] ..... E06B 7/20

[52] U.S. Cl. ..... 49/308; 49/306; 49/304; 49/303

[58] Field of Search ..... 49/308, 307, 306, 49/305, 304, 303

[56] References Cited

U.S. PATENT DOCUMENTS

| | | | |
|---|---|---|---|
| 813,268 | 2/1906 | Woodburn | 49/308 |
| 813,411 | 2/1906 | Eveleth | 49/308 |
| 2,250,821 | 7/1941 | Bedol | 49/308 |
| 2,820,261 | 1/1958 | Brown | 49/306 |
| 3,072,977 | 1/1963 | Burda | 49/307 |
| 4,089,136 | 5/1978 | Lapinski et al. | 49/308 |
| 5,467,559 | 11/1995 | Owens | 49/321 |

FOREIGN PATENT DOCUMENTS

| | | | |
|---|---|---|---|
| 224878 | 5/1962 | Austria | 49/308 |
| 846785 | 8/1952 | Germany | 49/308 |
| 1181389 | 11/1964 | Germany | 49/308 |
| 1185505 | 1/1965 | Germany | 49/308 |
| 285700 | 1/1953 | Switzerland | 49/308 |
| 274376 | 7/1927 | United Kingdom | 49/308 |
| 319116 | 9/1929 | United Kingdom | 49/308 |
| 686612 | 1/1953 | United Kingdom | 49/308 |

*Primary Examiner*—Daniel P. Stodola
*Assistant Examiner*—Gregory J. Strimbu
*Attorney, Agent, or Firm*—McGlew & Tuttle, PC

[57] ABSTRACT

A draft strip device for a door includes a channel support section which is fixed at a base of the door. A movable part is mounted in the channel support section. The movable part is movable towards and away from the floor under the door. At least one weather strip seal is supported by the movable part and rests on the floor when the movable part is lowered. A pushing element is at one end of the movable part. The pushing element is intended to be engaged with a respective doorjamb to bring about a lowering of the movable part and the resting on the floor of the weather strip seal when the door is closed. At least one adjusting element is provided to adjust a position of the movable part. A first brace and a first attachment slide and an adjusting slide are provided. The first brace is connected at its ends to the first attachment slide, which is inserted and can be moved longitudinally in the support section, and to the adjusting slide, which is inserted and can be moved longitudinally in the movable part. A second attachment slide, a stop slide and a second brace are provided. The second brace is connected at its ends to the second attachment slide and to the stop slide, the second attachment slide is inserted and movable longitudinally in the support section. The stop slide is arranged and can be moved within certain limits in the longitudinal direction in the movable part and the first and second attachment slides are connected by an intermediate connecting section. The intermediate connecting section is movable longitudinally with the first and second attachment slides in the support section. The pushing element is connected to the first attachment slide in an adjustable manner. The adjusting element is connected to the adjusting slide. A third rigid brace connects the movable part to the support section. The third brace has a foot, which is hinged to the stop slide, and a head that is movably coupled to the second attachment slide. The third brace rests against locking nibs which are integral with the support section. The third brace extends into a crevice made in the second attachment slide, and the head is disposed in a longitudinal guide inside the support section.

11 Claims, 6 Drawing Sheets

DRAFT STRIPS FOR DOORS INCLUDING A MOVABLE MEMBER CONNECTED TO AN ADJUSTING SLIDE

FIELD OF THE INVENTION

The present invention pertains to draft strips or ground seals for doors.

BACKGROUND OF THE INVENTION

Draft strips have already become known, which comprise:

a channel-like section to be fixed in a seat at the base of the leaf of a door;

a movable part that is mounted in the fixed channel-like section, which can be moved in height, towards and away from the floor under the door;

at least one weather strip supported by the movable part and intended to rest on the ground when the part is lowered;

a pushing element at at least one end of the movable part intended to be engaged with a corresponding doorjamb to bring about the lowering of the movable part and the resting on the ground of the weather strip when the door is closed; and at least one means to adjust the position and the action of the movable part.

Also in such embodiments, the movable part is supported by an intermediate section, which is articulated by means of parallelogram-shaped levers and/or by return springs, and the intermediate part can be inserted longitudinally in the fixed channel-like section to simplify its mounting, and it can be extracted for maintenance, replacement, etc.

The draft strips are functional, but also are not free of drawbacks. In fact, the movable part with the seal tends, in general, to compress the seal mainly in its part that is adjacent to the pushing element than in its opposite end part, with the resulting impossibility in any case of completely closing the crack under the door since the seal may remain partially raised in the part that is less compressed. This happens because the movable part is connected to the support section or to the intermediate section by levers and/or by articulation springs, of which only the one closest to the pushing element is moved directly by this element, while that/those which is/are furthest away is/are moved only indirectly by means of the rigidity of the movable part itself. Moreover, in such embodiments, the pushing element is connected to one end of the movable part with the seal with resulting transmission of the forces directly onto the coupling point.

In order to eliminate these drawbacks, two opposite pushing elements have been used, at the ends of the movable part, which interact with opposite jambs of the door. However, the design of the device is complicated, and its function requires specific measures and a very careful working application.

The adjusting means that is provided makes it possible to vary the horizontal position of the movable part to correct the resting on the ground of the, seal according to the inclination of the floor. However, when adjusted, the movable part maintains the new horizontal position even if it is raised from the ground when the door is open, with the result that it remains inclined under the base of the door, without being able to completely return into the resting position in the support section. This may then result in, during the opening or closing of the door, a rubbing of the seal on the floor if the surface of same is irregular or inclined, with a reduction in the crack under the door starting from the jamb against which the door is closed.

SUMMARY AND OBJECTS OF THE INVENTION

The present invention is aimed at solving the above-mentioned drawbacks of the draft strips of the prior art and thus at providing a device, in particular a device having a movable part, which can be extracted more efficiently and more effectively from the fixed support section, thanks to a novel combination and arrangement of its components.

For this purpose, the present invention contains improvements made to the articulation means of the movable part for its lowering and raising movements, to the control means and to the adjusting means of the movable part and a seal at the opposite ends of the device against the doorjambs.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figures 1, 3:
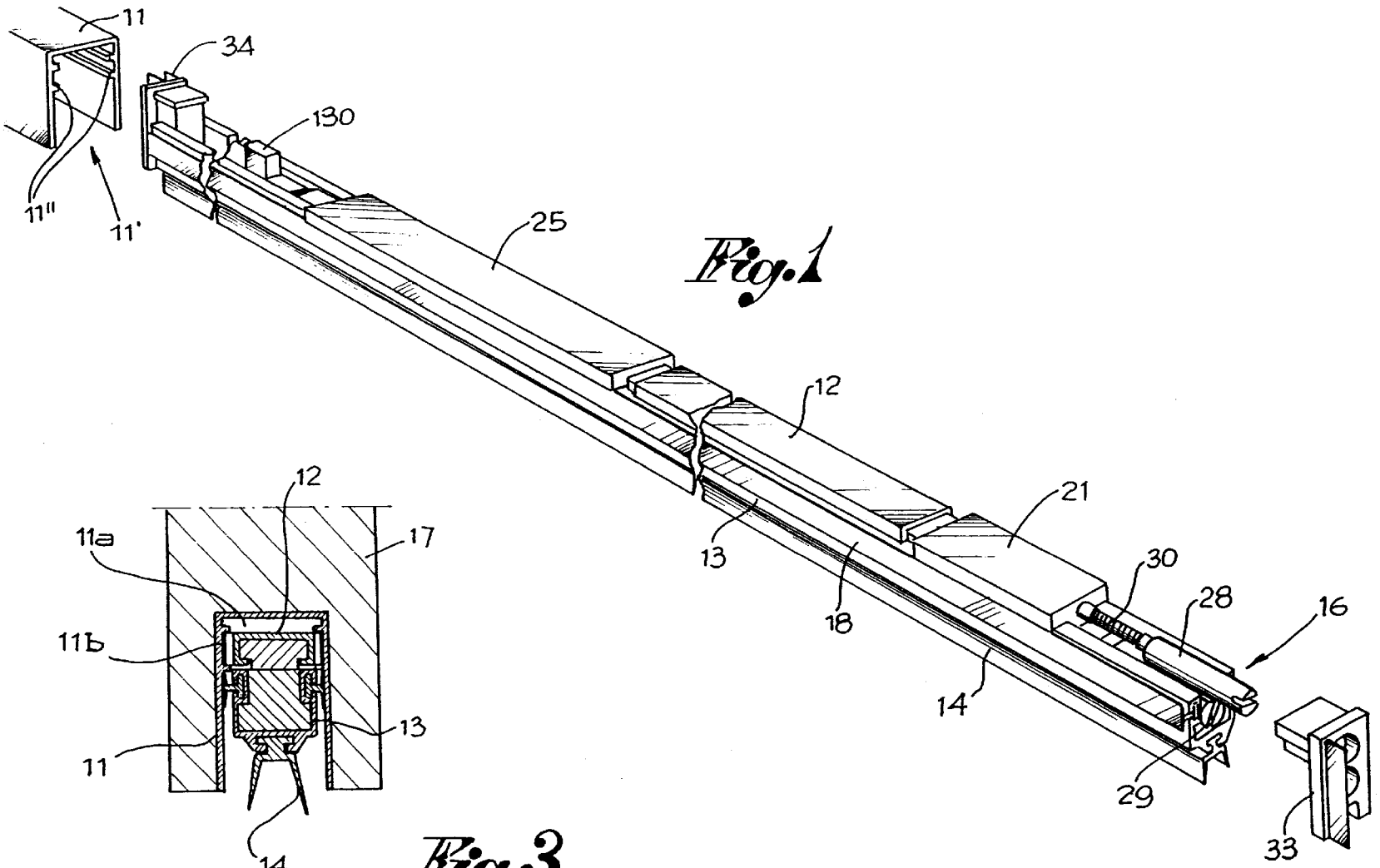
FIG. 1 is a perspective view of the movable part with the respective intermediate section extracted from the fixed support section according to a first exemplary embodiment of the present invention.
FIG. 3 is a cross sectional view according to the arrows III—III in FIG. 2.
Figure 2:
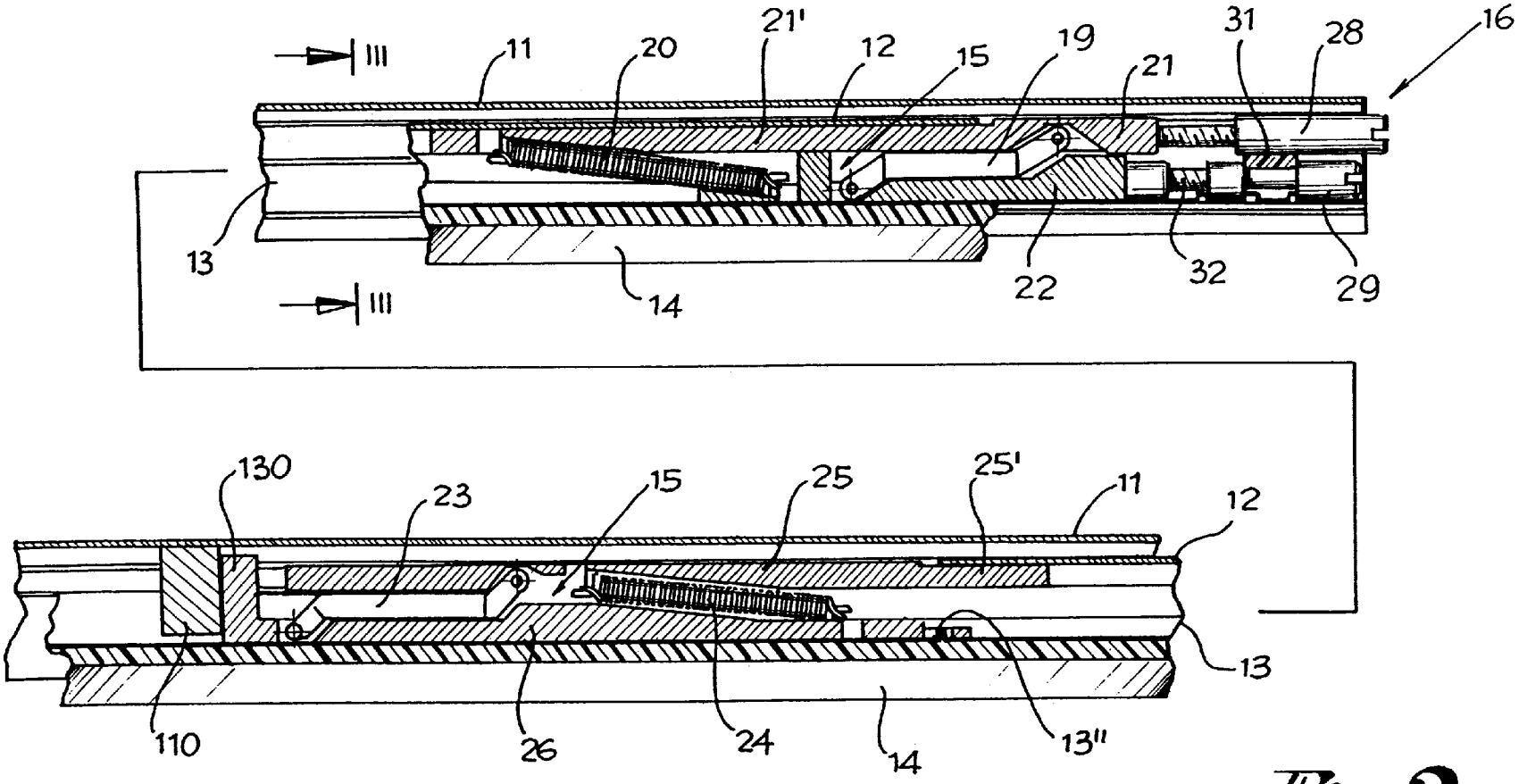
FIG. 2 is a longitudinal sectional view of the device of FIG. 1, which is assembled and in the raised, resting position.
Figure 4:
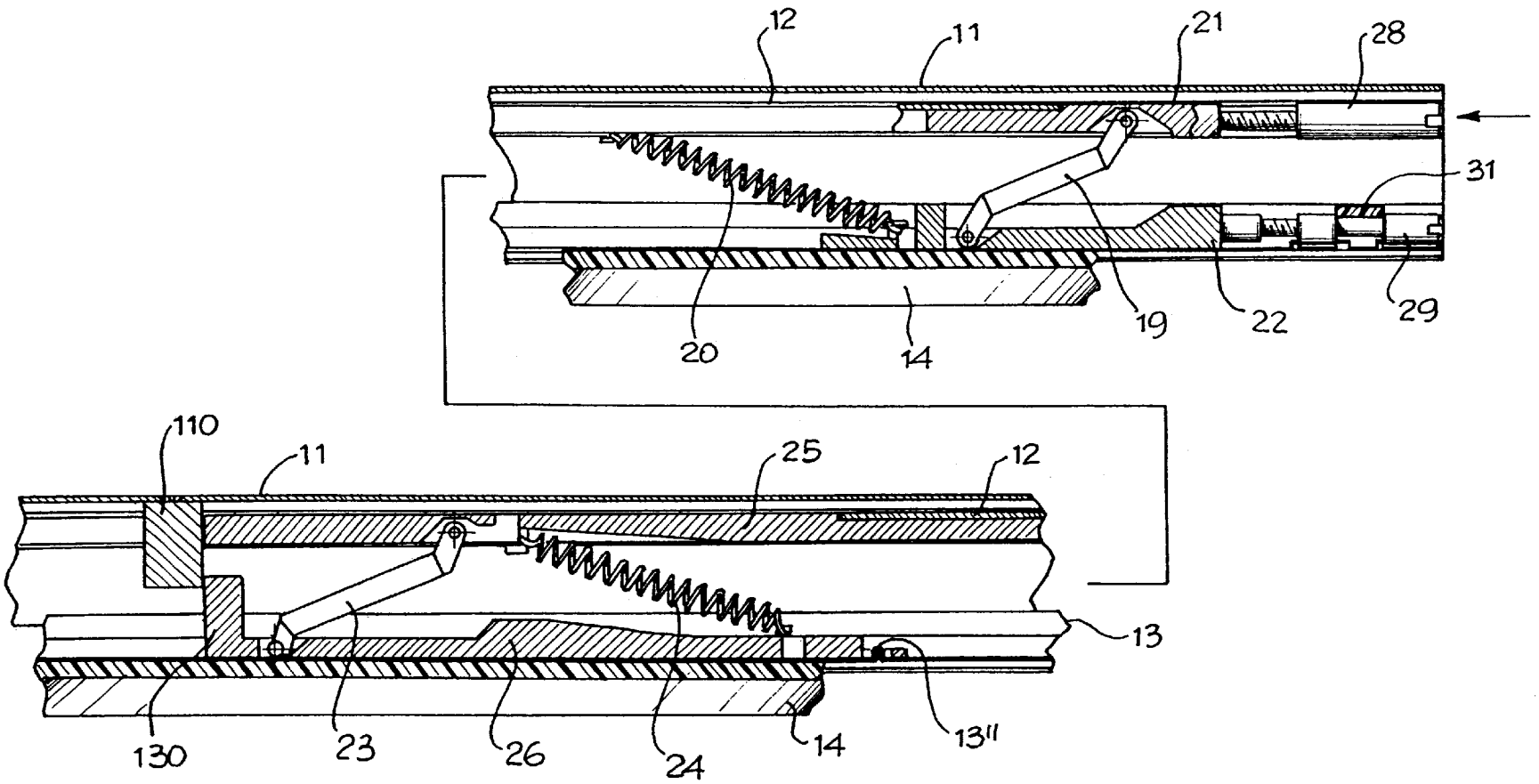
FIG. 4 is a view similar to that of FIG. 2, but with the device in the lowered, operating position.
Figures 5, 7, 9, 10:
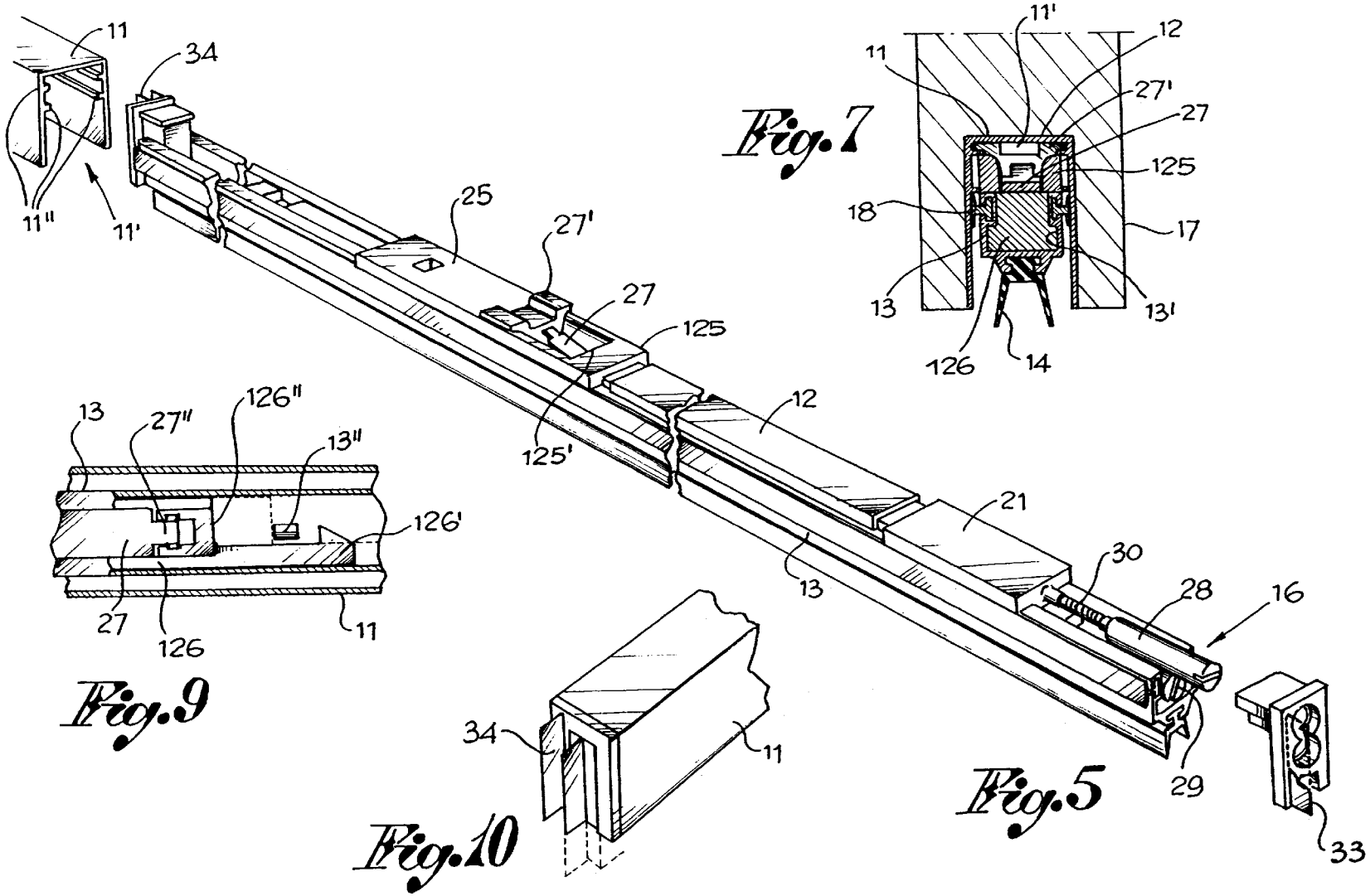
FIG. 5 is a perspective view of the movable part with the respective intermediate section extracted from the fixed support section according to another embodiment of the present invention.
FIG. 7 is a cross sectional view according to the arrows VII—VII in FIG. 6.
FIG. 9 is a detail view related to the coupling of the stop slide.
FIG. 10 is an end view of the device on the opposite side of the pushing element.
Figure 6:
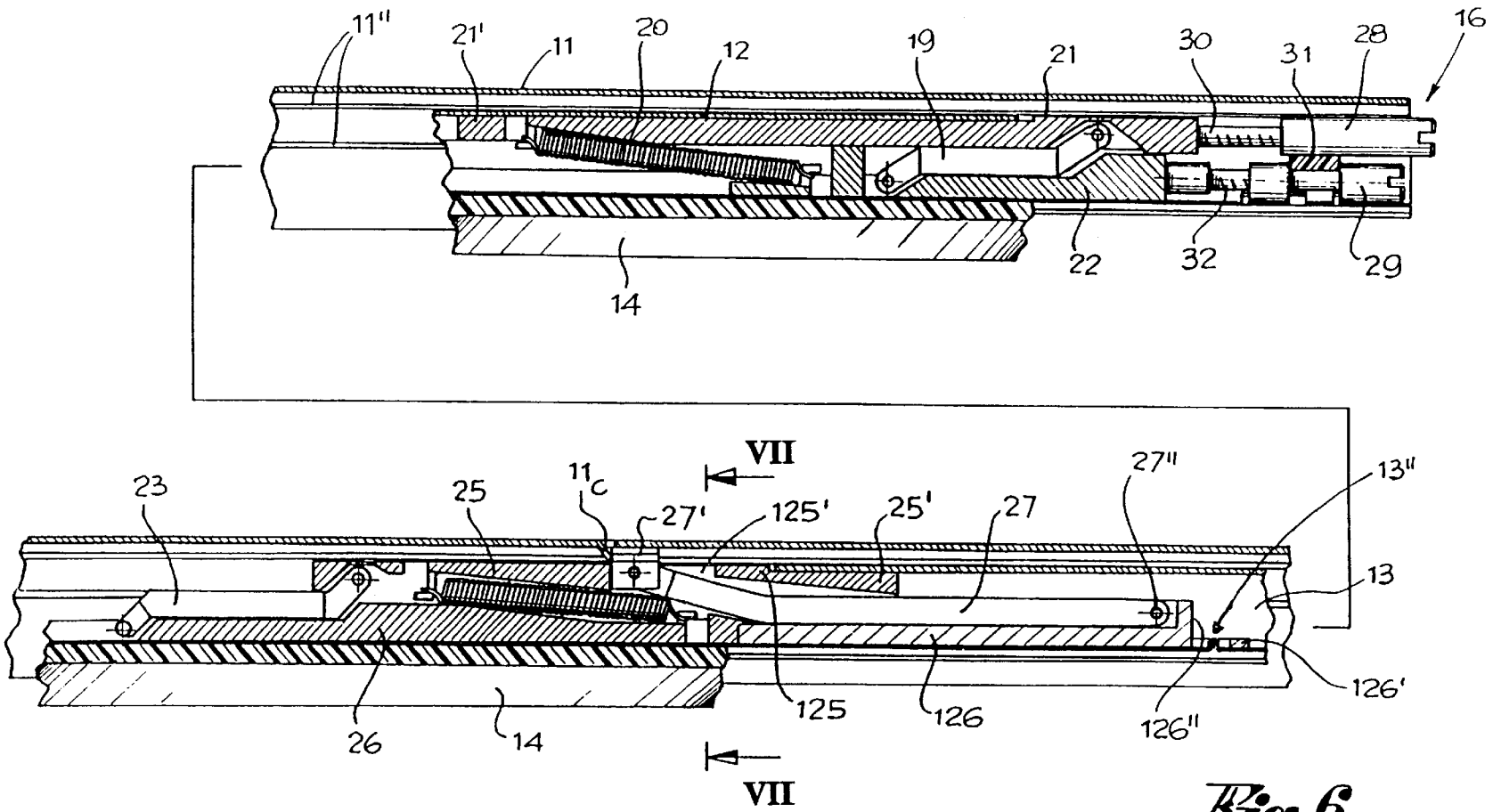
FIG. 6 is a partial longitudinal sectional view of the device of FIG. 5, which is assembled and in the raised, resting position.
Figure 8:
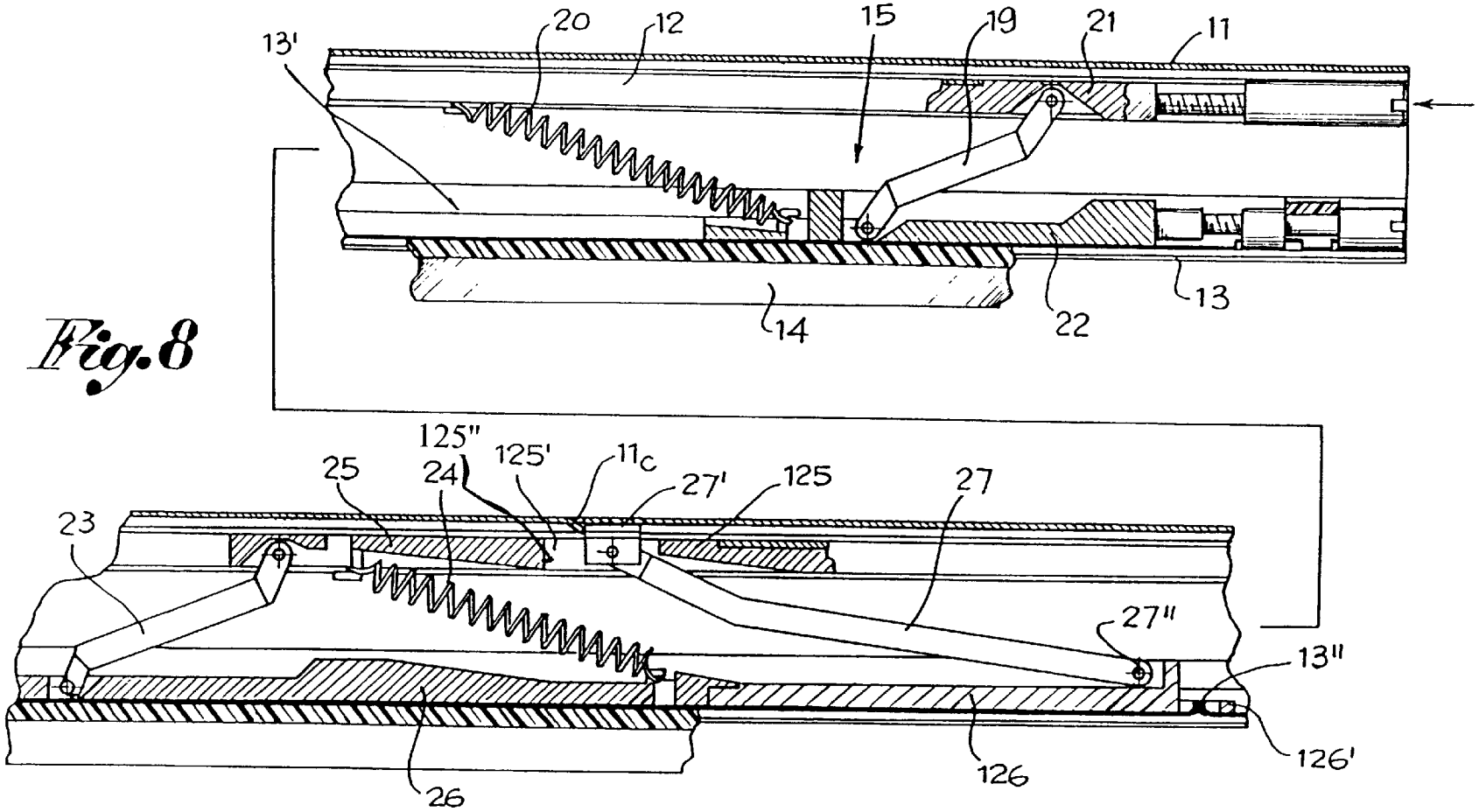
FIG. 8 is a partial view similar to that of FIG. 7, but of the device in the lowered, operating position.

Referring to the drawings in particular, the draft seal in question essentially comprises a fixed support section 11, an intermediate connecting section 12 inserted into the fixed section, a movable part 13, at least one weather strip 14, the means 15 for connecting the movable part 13 to the support section 11, and pushing and adjusting means at one end of the movable part.

The fixed support section 11 has an essentially inverted-U-shaped section and defines a channel-like seat 11. The support section 11 open towards the bottom. The support section is fixed to the base of the jamb of a door 17, preferably in a groove provided in the base of the jamb of the door 17 proper (see FIG. 3). The guide faces 11", which delimit two parallel sliding tracks 11*a* and 11*b*, are provided longitudinally on the internal faces of the sides of the support section 11.

The intermediate connecting section 12, which is essentially a C-shaped section, is inserted longitudinally into the fixed support section 11 from one end of the fixed support section 11, and possibly guided in the guide track 11*b*, with the possibility of insertion, sliding and extraction.

The movable part 13 consists of a section with a channel-like longitudinal seat 13' which is open towards the top. The movable part 13 is supported by the support section 11 by means of the connection means 15 and is inserted into the section, which can be moved in height towards and away from the floor under the door 17.

The movable part 13 has on its sides the lateral seals 18 for airtightness between the part and the sides of the fixed support section 11 (cf. FIG. 3) and, at the bottom, the weather strip 14, which is intended to rest on the floor under the door when said door is closed.

The means 15 for connecting the movable part 13 to the support section in the embodiment shown in FIGS. 1–4 comprise:

- a first attachment slide 21, which is inserted and slides in the track 11*b* of the support section 11, and an adjusting slide 22, which is inserted and slides in the channel-like seat 13' in the movable part 13;
- a first brace 19 and a first return spring 20, which are connected, on the one hand, to the first attachment slide 21, and on the other hand, to the adjusting slide 22;
- a second attachment slide 25, which is also inserted and slides in the track 11*b* of the support section 11, and a stop slide 26, which slides in the movable part 13 and is engaged against a nib 13" on the bottom of the movable part 13 in order to limit its movements; and
- a second brace 23 and a second return spring 24, which are connected, on the one hand, to the second attachment slide 25, and on the other hand, to the stop slide 26.

The intermediate connecting section 12 is arranged as a spacer between the two attachment slides 21 and 25, such that the movement of the first slide is transmitted to the second slide as will become evident below, and making it possible, however, for each slide to move independently as well.

The sections 11, 12, 13 are preferably made of extruded aluminum; the base 14 and lateral 18 weather strips are made of an elastomer or hard material; the other components described so far are made of a plastic material, except for the springs 20 and 24, which are made of steel.

In greater detail, the first and second braces 19 and 23 are connected to the slides 21, 22; 25, 26, respectively, with pins, which are integral with the braces proper. The first and second springs 20 and 24 have their ends coupled to the hooks, which are integral with the corresponding, above-mentioned slides, and they act in the manner of raising the movable part and returning it to the resting position when the door is opened.

The first and second attachment slides 21 and 25 each have a tail 21' and 25', with which it is coupled, for simple insertion, with the corresponding end of the intermediate connecting section 12.

This results in an easy and simple assembly and, if necessary, disassembly of the device without tools, making it possible, however, as stated above, for the slides to make longitudinal movements, which are also independent and free of the intermediate section.

The pushing and adjusting means 16 completes the device. The pushing and adjusting means 16 comprises a pusher 28 and an adjusting bush 29.

The pusher 28 is screwed to a threaded shank 30 that is integral with the first attachment slide 21 and is intended to rest against a doorjamb, usually the jamb on the side of the hinges of said door, when the door is closed. The adjusting bush 29 is mounted, in a rotating but not a translating manner, on a support 31 that is locked in the channel-like seat of the movable part 13 and is coupled with a threaded shank 32, which is fixed to the adjusting slide 22 which is guided in the movable part 13. The screwing/unscrewing of the pusher 28 and the adjusting bush 29 make it possible to adjust the control force on the device and to correct the horizontal position of the movable part and thus its uniformity of resting on the ground.

In the device described so far, the first and second braces 19, 23 are oriented in the same direction, are essentially parallel and are turned in the direction of the force on the pusher from the related attachment slides 21 and 25 respectively towards the adjusting slide 22 and the stop slide 26, respectively. The first and second springs 20 and 24 are oriented in the same direction, are essentially parallel, but are turned in opposite directions in relation to the connected braces 19 and 23.

Moreover, it should be noted that, in place of the braces and the springs with related specific functions, it is possible to use only the springs arranged in the same manner as the two braces and with a dual function of the means for supporting and guiding the movable part and of elastic means for the return of the same in the raised position. Therefore, the springs with dual function are integral with the slides, which are inserted and/or locked in the track 11*b* of the support section and in the channel-like seat of the movable part.

A rabbet 130, which rests against a lock 110 provided in the support section 11, limiting the longitudinal movements of the movable part and forcing the latter to lower when a force is applied to the pusher, is inserted and held in the movable part 13.

In addition, the lock 110, in cooperation with the second attachment slide 25, may limit the lowering of the movable part 13 such that the lateral seals 18 of the movable part do not have to leave from the bottom of the support section thus making it difficult or impossible for them to return. It should be noted that the second slide 25 has, therefore, a selected length to rest against the lock 110 when the movable part 13 is forced to drop. This limits the movements of the two attachment slides in order to limit the vertical movement of the movable part.

With this arrangement, the force exerted on the pusher 28 by the jamb, when the door is closed brings about the longitudinal movement of the pusher proper and of the first attachment slide 21 and of the second attachment slide 25 by means of the connecting section 12. The movable part 13, which is supported by braces, is opposed by the lock 110, which, resting against the rabbet 130, also force, the stop slide to rest against the nib 13".

Therefore, the braces 19, 23 rotate about their connection to the slides, permitting the simultaneous movement of the pusher, of the first and the second attachment slide so as to force the movable part to drop vertically until it rests on the floor under the closed door. The movable part is then pressed on the ground advantageously with a pressure that is uniformly distributed over the entire length of its seal, i.e., it compresses the end part of the movable part that is furthest from the pusher and that which represents the least stressed part in the prior-art embodiments. As soon as the door is opened, the reaction of the spring carries the movable part upwards.

In the exemplary embodiment that is shown in FIGS. 5–9, the draft strip maintains the special features already described with reference to FIGS. 1–4 as to the combination and the connection between the support section 11 and the movable part 13, and the parts that are the same or similar to those of FIGS. 1–4 are indicated with the same reference numbers.

In this embodiment, the rabbet 130 and the locking means 110 were eliminated, and a third brace 27 was used, which may be rigid or spring-actuated and arranged next to the second attachment slide, towards the end of the device opposite that end with the pushing means 16, or between the two slides 21, 25 connected by the section 12.

In this case, the third brace 27—rigid or spring-actuated—is oriented in the opposite direction of the first and second braces, i.e., in the direction of the control force starting from a foot 27" towards a head 27' of the brace. The head 27' is connected to a third attachment slide 125, which may be integral with or combined with the second attachment slide 25, and the foot 27" is connected to an extension 126 in line with the stop slide 26 that is integral with or combined with same.

The head 27' of the third brace 27 rests in a crevice 125' that is made in the third attachment slide 125 and protrudes above same in order to be engaged longitudinally in the guide 11*a* of the support section 11. The foot 27" of the third brace 27 is connected to the extension 126 with a corresponding pin. Even in this case, a nib 13", which is intended to interact, alternately, on the one hand, with a shoulder 126" at one end of the stop slide 26 or of its extension 126, and on the other hand, with a hook 126' at the end of a shank that extends from the slide 26 or from the extension, is provided on the bottom of the movable part 13 (of FIG. 9). This is in order to limit the longitudinal movements of the stop slide and thus the foot of the third brace, in one direction, with the shoulder 125", during the descent, and in the opposite direction, with the hook 126', in the phase of adjusting the horizontal position.

The head 27' of the third brace, with the device assembled, rests and is constantly checked longitudinally, in the direction of insertion of the movable part in the support section 11, against locking nibs 11*c* on the bottom of the support section.

On the other hand, a crevice 125' is provided to make it possible for the third slide 125 to slide in relation to the head of the third brace, and its length is so as to limit this sliding and to correspondingly limit the lowering of the movable part 13 in relation to the support section 11, even here so that the lateral seals of the movable part do not have to leave from the bottom of the support section with subsequent difficulty or impossibility of their return.

In the embodiment according to FIGS. 5–9 as well, the attachment slides 21, 25, or the first attachment slide 21 and the third slide 125, are coupled to the connecting section 12 with their corresponding tails and they can also move independently of one another. However, the force applied to the pusher 28 when the door is closed brings about the longitudinal movement of the pusher, of the first attachment slide 21, to which this pusher is connected, and by means of the connecting part 25', of the second attachment slide 25, which slides in relation to the head 27' of the third brace 27. Consequently, the action of the braces causes a longitudinal movement of the stop slide 26 until its makes its end shoulder 126" or the corresponding extension rest against the nib 13". Thus, on the one hand, the head 27' of the third brace 27 rests against the corresponding nibs 11*c* and, on the other hand, the stop slide 26 (or its extension) rests against the corresponding nit) 13", whereby the third brace is forced to rotate towards the bottom simultaneously with the parallel braces 19, 23. This causes the lowering of the movable part, forcing its seal to rest on the ground with a pressure that is uniformly distributed over its entire length, even in the part that is furthest from the pusher 28, to which the control force is applied.

Thus, the device shall be more effective, and the action of the Basic seal shall be excellent.

In addition, the twofold adjustment of the pusher 28 and of the adjusting bush 29, which is, however, applied to two different, overlapping and parallel components, which are represented by the first attachment slide 21 and by the adjusting slide 22, makes it possible to better adjust the working device. This is done by varying the distance between the braces 19, 23 thanks to the free sliding of the tails of the attachment slides in the connecting section 12 and of the shank with hook 126' in the movable part 13.

The entire unit then also makes possible the movements of the movable part 13 for its complete return into the resting position either for its adjustment for resting or for its work on the ground.

When the third, rigid or spring-actuated brace 27, always oriented in the opposite direction of the braces 19, 23, is arranged independently next to the second brace at the end of the device that is furthest from the pusher, this also makes possible a sensitive rocking movement of the movable part for its adjustment to the ground and a correct return into the resting position.

Finally, at the opposite ends of the device in any of its embodiments, the head weather strips 33, 34, respectively, are inserted, which are supported by corresponding supports and are intended for resting against opposite doorjambs, when this door is closed, for an airtightness even at the opposite ends of the device, which is currently done with seals on the jambs.

While specific embodiments of the invention have been shown and described in detail to illustrate the application of the principles of the invention, it will be understood that the invention may be embodied otherwise without departing from such principles.

What is claimed is:

1. A draft strip device for a door the device comprising:

a channel support section adapted to be fixed on a base of the door;

a movable part mounted in said channel support section, said movable part being movable between an extended position and a retracted position;

at least one weather strip seal supported by said movable part and intended to rest on a floor when said movable part is in the extended position;

a pushing element attached to said movable part, said pushing element being intended to be engaged with a respective doorjamb to bring about movement of said movable part toward the extended position when said door is closed;

at least one adjusting element to adjust a position of said movable part;

a first brace;

a first attachment slide and an adjusting slide, said first brace being connected at its ends to said first attachment slide, which is inserted and can be moved longitudinally in said support section, and to said adjusting slide, which is inserted and can be moved longitudinally in said movable part;

a second attachment slide;

a stop slide;

a second brace connected at its ends to said second attachment slide and to said stop slide, said second attachment slide being inserted and movable longitudinally in said support section, said stop slide being arranged and movable longitudinally within certain limits in said movable part said first and second attachment slides being connected by an intermediate connecting sections, said intermediate connecting section being movable longitudinally with said first and second attachment slides in said support section, said pushing element being connected to said first attachment slide in an adjustable manner, said adjusting element being connected to said adjusting slide;

a third, rigid brace connecting said movable part to said support section, said third brace having a foot, which is hinged to said stop slide, and a head that is movably coupled to said second attachment slide and resting against locking nibs which are integral with said support section, said third brace extends into a crevice made in said second attachment slide, and said head is disposed in a longitudinal guide inside said support section.

2. A device in accordance with claim 1, wherein said head of said third brace is hingedly attached to said second attachment slide.

3. A device in accordance with claim 1, wherein ends of said first and second braces are hinged to said first and second slides, respectively.

4. A device in accordance with claim 1, wherein said third brace is arranged between said first and second braces.

5. A device in accordance with claim 1, wherein:

said first and second braces are essentially parallel to one another;

said first and second braces extend generally in the same direction from said first and second attachment slides towards said adjusting slide and said stop slide, respectively; and said third brace is oriented in a direction that is opposite that of said first and second braces, from its head towards its foot.

6. A device in accordance with claim 1, wherein said attachment slides and said connecting section are adapted to move longitudinally independently from one another.

7. A device in accordance with claim 1, wherein said stop slide has an end shoulder which is intended to rest against a nib disposed on said movable part in order to limit said movement of said stop slide in one direction, and said movement of said stop slide in a direction opposite to said one direction is limited by a hook at an end of a shank that is integral with said stop slide interacting with said nib of said movable part.

8. A device in accordance with claim 1, wherein said adjusting element is a bush, which is mounted rotatably on a support that is locked in said movable part and is attached to a threaded shank, which is fixed to said adjusting slide.

9. A device in accordance with claim 1, wherein lateral weather strips are provided on both ends of said movable part.

10. A device in accordance with claim 1, wherein said first and second braces are rigid and a first spring is associated with said first brace and a second spring is associated with said second brace for movement of said movable part toward said retracted position.

11. A device in accordance with claim 10, wherein:

said first and second braces are essentially parallel to one another.

* * * * *